United States Patent [19]

Wellman

[11] 4,182,596

[45] Jan. 8, 1980

[54] DISCHARGE HOUSING ASSEMBLY FOR A VANE AXIAL FAN

[75] Inventor: Donald C. Wellman, Marcellus, N.Y.

[73] Assignee: Carrier Corporation, Syracuse, N.Y.

[21] Appl. No.: 878,193

[22] Filed: Feb. 16, 1978

[51] Int. Cl.[2] ..... F04D 29/54

[52] U.S. Cl. ..... 415/207; 415/209

[58] Field of Search ..... 415/207, 206, 204, 199.6, 415/199.4, 209, 219 B, 219 C, 1

[56] References Cited

U.S. PATENT DOCUMENTS

| | | | |
|---|---|---|---|
| 1,578,843 | 3/1926 | Moody | 415/207 X |
| 2,724,545 | 11/1955 | Oechslin | 415/207 X |
| 3,059,833 | 11/1962 | Benoit | 415/209 |

FOREIGN PATENT DOCUMENTS

| | | | |
|---|---|---|---|
| 370362 | 5/1973 | Czechoslovakia | 415/206 |
| 466345 | 6/1975 | Czechoslovakia | 415/207 |
| 931344 | 10/1947 | France | 415/199.6 |
| 901896 | 7/1962 | United Kingdom | 415/209 |

*Primary Examiner*—Leonard E. Smith

*Attorney, Agent, or Firm*—J. Raymond Curtin; Barry E. Deutsch

[57] ABSTRACT

A vane axial fan assembly includes a housing defining a chamber to receive a fluid discharged from the blades of the vane axial fan. The housing includes a substantially spiral shaped scroll portion defining a chamber of substantially constantly increasing radius and having a substantially spiral shaped baffle member mounted within said chamber and combining to define therewith a simultaneously radially and axially expanding fluid flow passage for receiving the fluid discharged from the blades of the fan.

3 Claims, 6 Drawing Figures

DISCHARGE HOUSING ASSEMBLY FOR A VANE AXIAL FAN

BACKGROUND OF THE INVENTION

This invention relates to vane axial fan assemblies, and in particular, to an improvement in the design of the discharge plenum or chamber adapted for receiving the air discharged from the blades of the fan assembly.

The utilization of large fans, such as vane axial and centrifugal fans, in many different applications is well known to the art. For example, such fans may be employed in central station air handling equipment employed in air conditioning systems for multi-story buildings such as offices, schools and the like. Each of the two types of fans mentioned above have different characteristics which make each suitable for different applications. As an example, a vane axial fan with controllable pitch blades has certain characteristics that provide operational cost savings at partial loads in a variable volume air supply system when compared to a centrifugal fan; however, the cost of a centrifugal fan is somewhat lower than the cost for a comparable vane axial fan. In addition, the centrifugal fan provides a more compact assembly and provides greater flexibility when compared to a standard vane axial fan assembly. The compactness and flexibility inherent in a centrifugal fan when compared to a vane axial fan is primarily due to the Archimedean-shaped scroll normally employed for receiving the air discharged from the blades of the fan. The discharge chamber or plenum typically employed with a vane axial fan is generally an elongated cylindrically shaped member of substantial axial length.

In many applications, it has been found advantageous or desirable to employ a vane axial fan assembly. However, in many of such applications, the utilization of a vane axial fan has not been possible due to the fan assembly's inherent lack of flexibility and compactness. Accordingly, centrifugal fans have been utilized to a much greater extent than have vane axial fans.

To achieve the compactness and flexibility offered by a centrifugal fan, a vane axial fan has been combined with essentially a centrifugal type Archimedean-shaped discharge scroll. There is no known prior art wherein this combination has been previously used.

SUMMARY OF THE INVENTION

It is an object of this invention to improve the design of the discharge chamber or plenum of a vane axial fan assembly.

It is a further object of this invention to combine a vane axial fan with essentially an Archimedean-shaped discharge scroll.

It is yet another object of this invention to simultaneously radially and axially expand the fluid discharged from the blades of a vane axial fan.

It is still another object of this invention to increase the flexibility and compactness of a vane axial fan assembly.

It is yet another object of this invention to reduce the noise level generated by the flow of air through the discharge plenum of the vane axial fan assembly.

These and other objects of the present invention are attained in a vane axial fan assembly including a housing defining a chamber to receive a fluid discharged from the blades of the vane axial fan. The housing includes a substantially spiral shaped scroll portion defining a chamber of substantially increasing radius and having a substantially spiral shaped baffle member mounted within said chamber and combining to define a simultaneously radially and axially expanding fluid flow passage for receiving the fluid discharged from the fan blades.

DESCRIPTION OF THE PREFERRED EMBODIMENT

Figure 1:
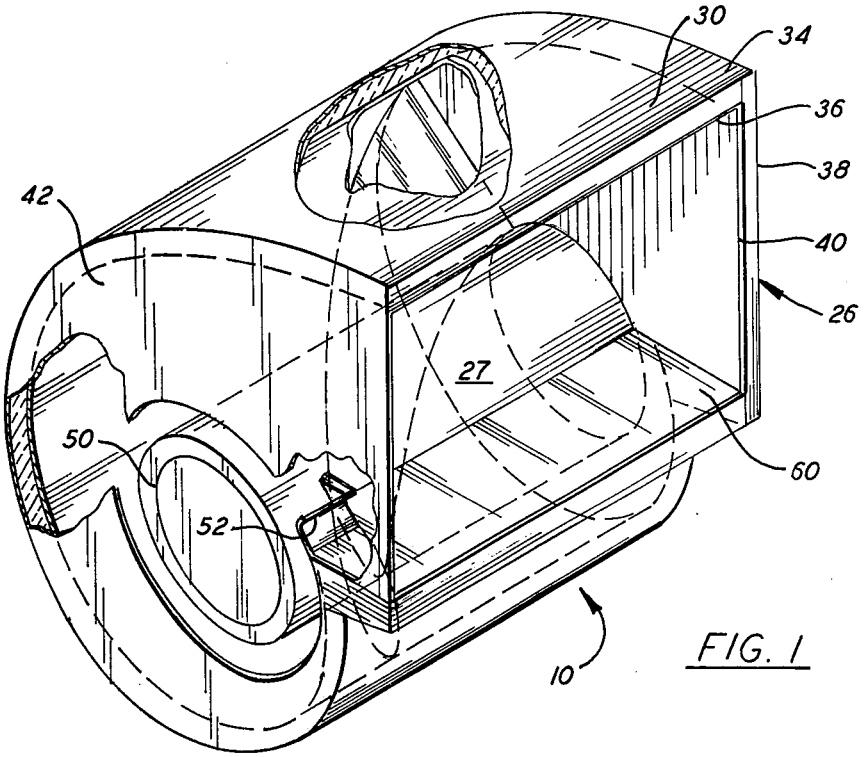
FIG. 1 is a perspective view of the discharge scroll for a vane axial fan in accordance with the present invention.

Referring now to the drawings, there is disclosed a preferred embodiment of the present invention. In referring to the various figures of the drawings, like numerals shall refer to like parts.

Figure 2:
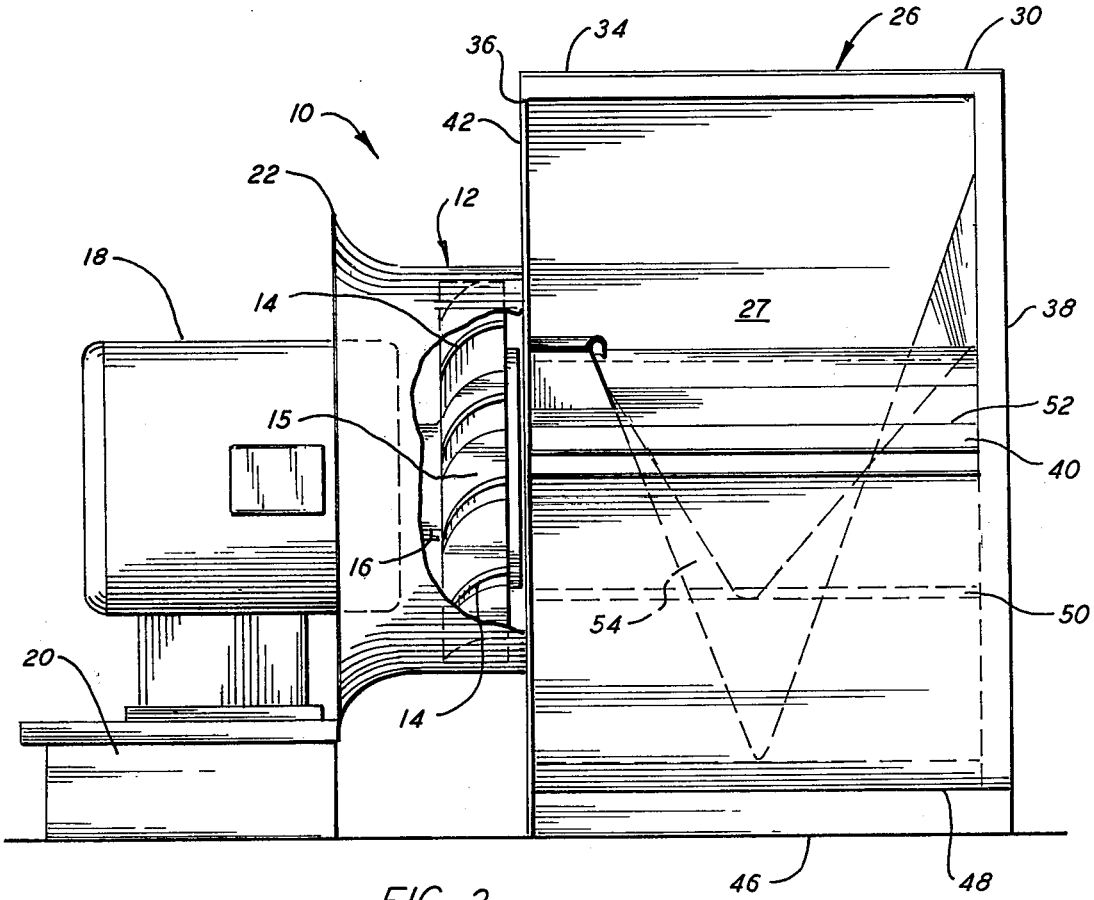
FIG. 2 is a side view of a vane axial fan assembly including the present invention.

Referring particularly to FIGS. 1 and 2, there is shown a vane axial fan assembly 10. The vane axial fan assembly includes a vane axial fan 12 comprising a plurality of vanes or blades 14 disposed circumferentially about wheel or hub 15 mounted on a shaft 16. The pitch of blades 14 may be controllable to regulate the air flow characteristics to match system requirements. The means for controlling the pitch of the blades may include linkage systems operated by electric or pneumatic means of types well known to those skilled in the art. Shaft 16 is operatively connected to a motor or other primary mover 18, energization of the motor resulting in rotation of the shaft and subsequent movement of the wheel mounting the blades. Typically, motor 18 is mounted on a base or support 20.

Fan assembly 10 further includes an inlet housing 22 in which wheel 15 mounting blades 14 is disposed. A fluid, such as air, is drawn into the venturi-shaped portion of inlet housing 22 and is discharged from the blades into a discharge scroll 26. The invention disclosed herein is particularly related to the discharge scroll.

The configuration of the discharge scroll 26 is essentially an Archimedean-shaped spiral of a type well known to those skilled in the art. Basically, the Archimedean-shaped spiral defines a constantly radially increasing chamber or passage. The discharge scroll comprises a housing 30. Preferably, the housing includes radially separated walls including top walls 34, 36; rear walls 38, 40; and bottom walls 46, 48. The housing further includes front wall 42. Each pair of walls sandwiches therebetween suitable sound absorbing material, as for example fiber glass insulation or foam plastic. The sound absorbing material has been found to reduce the noise level of the fan approximately 7 decibels in the 250 through 4,000 hertz band. Such sound attenuation has been accomplished with 2 inches of sound insulation placed between each pair of walls. As noted before, the chamber or plenum 27 defined by the walls of the housing is of a substantially constantly radially expanding configuration.

Figure 4:
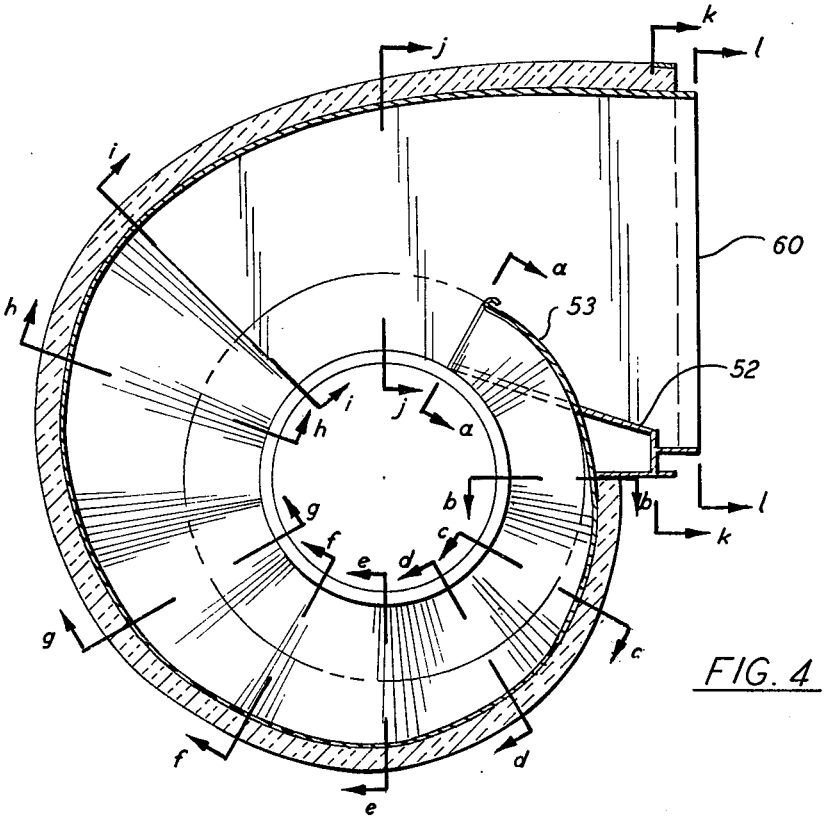
FIG. 4 is an end view of the discharge scroll of the vane axial fan assembly.

A substantially cylindrical member 50 is mounted within plenum 27, with the axis of said member being concentric with the longitudinal axis of the plenum. The diametrical width of cylindrical member 50 approximates the diametrical width of the hub of fan 12 to define between the outer wall of the cylindrical member and the inner wall of housing 30 a substantially donut-shaped flow passage for the fluid discharged from the blades of the fan. Secured to the housing and running along the axial length thereof is a horizontal baffle member 52 which reduces air turbulence in the flow of air through plenum 27. At the side of baffle member 52 and adjacent to fan 12, as shown in FIGS. 2 and 4, there is provided a cut-off member 53 formed by a continuation of the Archimedean-shaped housing and a second helically shaped baffle member 54 mounted in the plenum or discharge chamber. The cutoff plate cooperates with the inner face of housing 22 and with cylindrical member 50 to direct the fluid radially outward through the flow passage.

Figure 3:
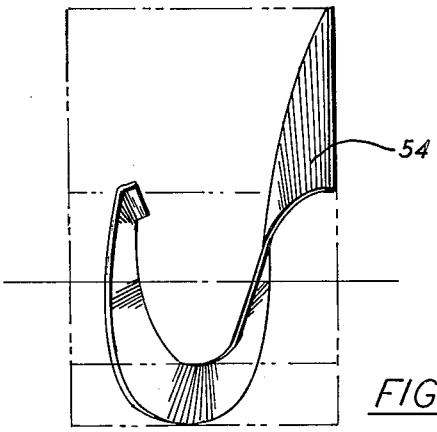
FIG. 3 is a perspective view of a detail of the present invention.

As shown in detail in FIG. 3, member 54 defines a spiral shaped, axially extending section, which cooperates with the Archimedean-shaped housing to define a simultaneously radially and axially expanding fluid flow passage through plenum 27.

The fluid discharged from blades 14 of the fan is directed by cutoff plate 53 and cylindrical member 50 radially outward. The fluid flows radially into plenum 27 defined by the Archimedean-shaped scroll, where the combination of the scroll and second baffle member 54 causes the fluid in the plenum to flow through a helical flow path which is simultaneously expanding both radially and axially. The fluid exits from the plenum through discharge opening 60 illustrated particularly in FIGS. 1 and 4.

Figure 5:
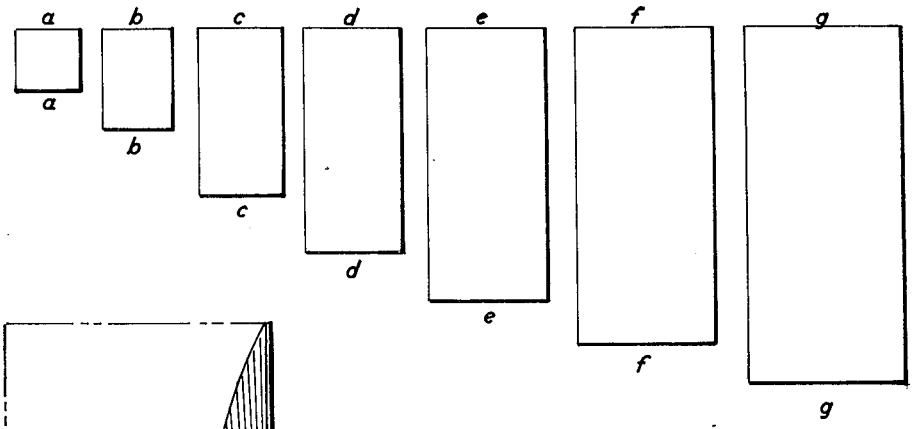
FIG. 5 comprises a number of sectional views taken along lines A—A through G—G in FIG. 4.
Figure 6:
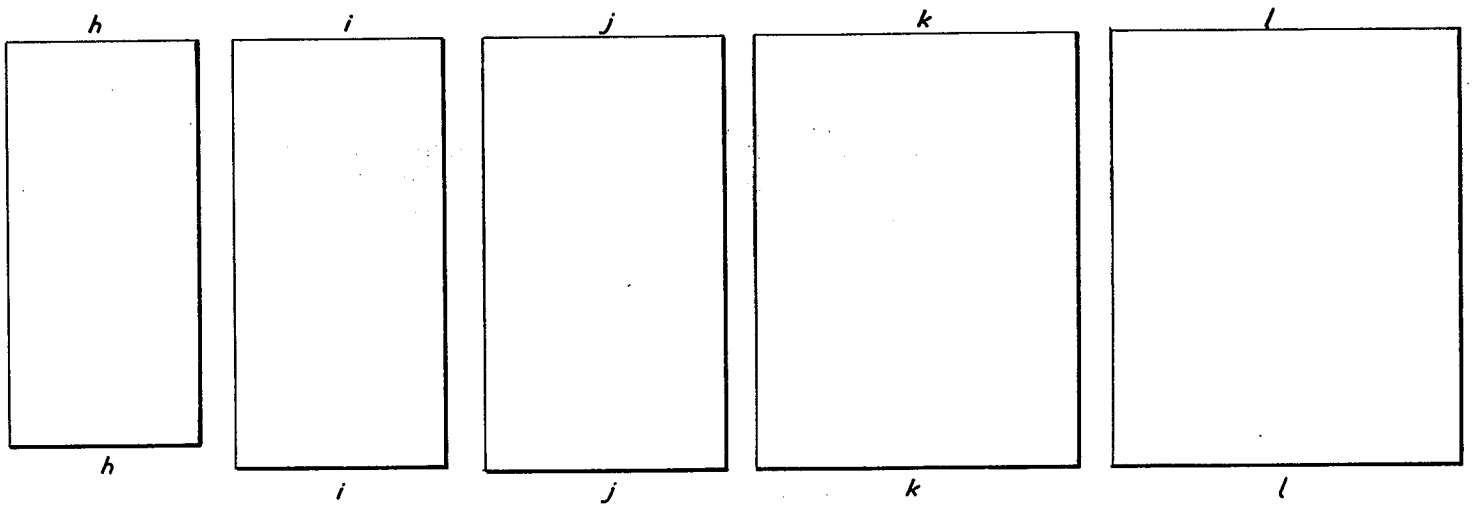
FIG. 6 comprises a number of sectional views similar to that shown in FIG. 5 taken along lines H—H through L—L of FIG. 4.

FIGS. 5 and 6 illustrate axial sections taken through discharge plenum 27. In particular, sections A—A through K—K, taken along corresponding lines in FIG. 4, illustrate the manner in which the fluid flow passage through plenum 27 expands axially and radially as a result of the disposition of second baffle member 54 within plenum 27. FIG. 4, in and of itself, effectively illustrates the manner in which housing 30 expands radially to define the Archimedean shaped scroll.

The discharge scroll hereinabove described provides a more compact and flexible assembly for vane axial fans than has heretofore been available. Typicaly, prior art vane axial fans have included substantially elongated axially extending discharge chambers intended to discharge the fluid in only one direction, i.e. in line with the center of the fan's inlet. By utilizing an Archimedean-shaped scroll in combination with a vane axial fan, the scroll may be rotated to discharge the fluid in either horizontal directions or vertically upward or vertically downward. In addition, by directing the fluid through a radially expanding flow path, sound attenuation heretofore obtained within the elongated axial flow path may be obtained through the relatively compact Archimedean-shaped scroll. As used herein, the word "compact" refers to the relative lengths of the Archimedean scroll and the discharge plenums heretofore employed with vane axial fans.

By providing a simultaneously radially and axially expanding discharge fluid flow path within plenum 27, the performance of the vane axial fan will approximate the performance of a centrifugal fan. Cylindrical member 50 is provided to insure that the fluid is directed radially outward through plenum 27 and thus will not stagnate along the axial centerline of housing 30. Horizontal baffle 52 cooperates with cylindrical member 50 to achieve the desired air flow pattern. To further improve sound attenuating characteristics of the fan assembly, it may prove advantageous to provide sound insulating material on all surfaces in contact with the air flow, as for example, baffle member 54 and cylindrical member 50.

It might be thought the same benefits might be obtained with the vane axial fan merely by utilizing a conventional Archimedean-shaped scroll. However, it has been found that the same results could not be so achieved. Primarily, the conventional Archimedean-shaped scroll is used with centrifugal fans wherein the air is discharged from the fan radially outward about the entire circumference thereof. In a vane axial fan, the air enters the discharge plenum axially at one end. In order to achieve the desired air flow characteristics, it has been found that it becomes essential to simultaneously radially and axially expand the air in the discharge plenum as compared to the radial expansion achieved in the standard scroll.

The utilization of a modified Archimedean-shaped scroll in combination with a vane axial fan provides the centrifugal fan's benefits of compactness and flexibility.

While a preferred embodiment of the present invention has been described and illustrated, the invention should not be limited thereto, but may be otherwise embodied within the scope of the following claims.

I claim:

1. In a vane axial fan assembly, the improvement comprising:

a housing including a substantially spiral shaped scroll portion defining a chamber for receiving a fluid discharged from the blades of said vane axial fan;

a first member mounted within said chamber and extending longitudinally along the center line thereof with one end of said member being substantially adjacent to and of substantially equal diametrical width as the hub of said vane axial fan, the other end of said member being in contact with an end wall of said scroll portion, and with the longitudinal exterior surface of said first member being spaced from the inner surface of said scroll portion to define therebetween a longitudinally extending flow passage for the fluid; and a substantially helically shaped baffle member mounted within said chamber having its outer edge contacting the inner surface of said scroll portion and its inner edge contacting the outer surface of said first member, said baffle member cooperating with said first member and said scroll portion to define a simultaneously radially and axially expanding fluid flow passage for the fluid discharged from said blades.

2. The invention in accordance with claim 1 wherein said first member is generally cylindrical.

3. The invention in accordance with claim 1 wherein the housing includes first and second radially spaced wall members having sound insulating material sandwiched therebetween.

* * * * *